US006016941A

United States Patent [19]

Damle

[11] Patent Number: 6,016,941

[45] Date of Patent: Jan. 25, 2000

[54] SUBMERGED ENTRY NOZZLE

[75] Inventor: Chandrashekhar S. Damle, Mayfield Heights, Ohio

[73] Assignee: LTV Steel Company, Inc., Cleveland, Ohio

[21] Appl. No.: 09/059,843

[22] Filed: Apr. 14, 1998

[51] Int. Cl.[7] ..... B22D 41/08

[52] U.S. Cl. ..... 222/606; 222/594

[58] Field of Search ..... 222/594, 606, 222/607, 591

[56] References Cited

U.S. PATENT DOCUMENTS

| | | | |
|---|---|---|---|
| 4,730,754 | 3/1988 | Buhr et al. | 222/606 |
| 4,746,038 | 5/1988 | Ohwada et al. . | |
| 4,779,775 | 10/1988 | Kimura et al. . | |
| 4,898,226 | 2/1990 | Teshima et al. . | |
| 5,083,687 | 1/1992 | Saito et al. . | |
| 5,244,130 | 9/1993 | Ozeki et al. . | |
| 5,501,430 | 3/1996 | Yamaoka et al. . | |

FOREIGN PATENT DOCUMENTS

| | | |
|---|---|---|
| 2225236A | 11/1974 | France . |
| 2241359A | 3/1975 | France . |
| 3839214 | 11/1988 | Germany . |
| 94/17937A | 8/1994 | WIPO . |

*Primary Examiner*—Scott Kastler
*Attorney, Agent, or Firm*—Watts, Hoffmann, Fisher & Heinke, Co., L.P.A.

[57] ABSTRACT

A submerged entry nozzle for introducing molten steel into a casting mold is disclosed. The nozzle includes nozzle structure defining a central bore and two transverse exit ports communicating with the bottom of the central bore, the central bore terminating at an upwardly dish-shaped bottom surface that extends to the periphery of the nozzle structure and forms the lower surface regions of the exit ports, whereby molten steel flowing across the upwardly dish-shaped bottom surface is directed outwardly and upwardly from the nozzle structure.

3 Claims, 6 Drawing Sheets

SUBMERGED ENTRY NOZZLE

FIELD OF THE INVENTION

The present invention relates to a submerged entry nozzle for introducing molten steel into a continuous casting mold, and more particularly to the structural configuration of the submerged entry nozzle.

BACKGROUND ART

In the continuous casting of steel, molten steel is delivered to a mold by means of a refractory tube which is submerged in the liquid steel. This refractory tube is referred to as a submerged entry nozzle and, in the case of slab casters, includes a central bore that terminates into two exit ports that extend transverse to the central bore. The purpose of the submerged entry nozzle is to prevent reoxidation of the steel. Aluminum is added to the molten steel to remove oxygen. While this may reduce or eliminate oxygen, it also has the undesirable side-effect of possibly clogging the passages of the nozzle with accretions of aluminum oxide. In conventional casting methods, nitrogen gas, argon gas or a mixture of the two gases is injected into the nozzle during casting to scrub the build up of accretions of aluminum oxide on the inside of the passages and to prevent non-metallic inclusions from adhering to the inside of the nozzle.

In the mold, a liquid slag layer is formed on the steel meniscus by adding or distributing mold powder into the mold on top of the molten steel. This liquid slag layer acts as both a lubricant in that it flows into the gaps between the solidifying steel shell and the mold as the molten steel solidifies, and as an insulator in that it inhibits heat from escaping the meniscus of the liquid steel.

To ensure an adequately thick slag layer, and thereby prevent the freezing of the steel near the meniscus, the temperature of the steel near the meniscus must be maintained sufficiently high. This is attained in conventional casting by the injection of argon gas into the submerged entry nozzle. The argon gas affects buoyancy in the liquid steel so that as the steel exits the exit ports of the nozzle it tends to rise towards the meniscus and therefore maintain a temperature sufficient to withstand freezing.

A deficiency in the production of molten steel and, in particular, ultra low carbon (ULC) and low carbon steel for exposed automotive applications, is the so-called pencil pipe defect. Pencil pipe defects arise from the entrapment of agglomerates of non-metallic inclusions and bubbles of argon gas under the solidifying shell of the steel being cast. The steel emerges from the caster in the form of a slab which is rolled down to a thin strip and collected as a coil. During subsequent processing of the strip the gas bubbles trapped under the skin of the strip, but now much closer to its surface, expand and form a blister on the surface of the finished product. Therefore, while use of argon gas reduces clogging, improves the slag layer thickness and increases the temperature near the meniscus, it also causes the undesirable pencil pipe defect due to trapped agglomerates of gas bubbles and inclusions.

The number of pencil pipe defects can be eliminated or substantially reduced by eliminating the injection of argon gas into the nozzle. However, in the absence of argon gas injection, it has been found in practice that there is a reduction in the slag layer thickness and, consequently, an increased risk that the steel near the meniscus will freeze. This can lead to the formation of surface defects known as "slivers".

These undesirable side-effects can be avoided, or their occurrence substantially reduced, by appropriately modifying the structure of the submerged entry nozzle, which is the object of the present invention.

SUMMARY OF THE INVENTION

The present invention provides a submerged entry nozzle for ensuring adequate slag layer thickness and heat delivery to the meniscus, whereby pencil pipe defects and slivers are minimized. According to the invention, the temperature near the meniscus is sufficiently high as to prevent the freezing of the steel at the meniscus in the absence of argon gas injection, or at rates of gas injection lower than that employed by conventional nozzles. It also ensures that the turbulence at the meniscus is not increased to a point that slag particles are entrained into the liquid steel stream.

The submerged entry nozzle includes nozzle structure that defines a central bore extending vertically through the structure. The central bore terminates at an upwardly dish-shaped bottom surface. The upwardly dish-shaped surface directs the flow of molten steel through two exit ports about 180 degrees apart. The exit ports are partially defined at an upper region by downwardly slanted lips and at a lower region by the upwardly dish-shaped bottom surface. Unlike prior nozzles that direct the flow of steel in a generally downward direction as it exits the nozzles, the dish-shaped bottom surface in combination with the downwardly slanted lips directs the exit flow of steel in a direction close to the horizontal. As a result, a greater portion of the steel turns up towards the meniscus in a shorter amount of time.

According to a feature of the invention, the upwardly dishshaped bottom surface is positively sloped at about an angle of 5 to 35 degrees with respect to a plane perpendicular to the vertically extending central bore. According to another feature of the invention, the downwardly slanted lips are negatively sloped at about an angle of 5 to 35 degrees with respect to a plane perpendicular to the vertically extending central bore.

Additional features will become apparent and a fuller understanding obtained by reading the following detailed description made in connection with the accompanying drawings.

BEST MODE FOR PRACTICING THE INVENTION

Figure 1:
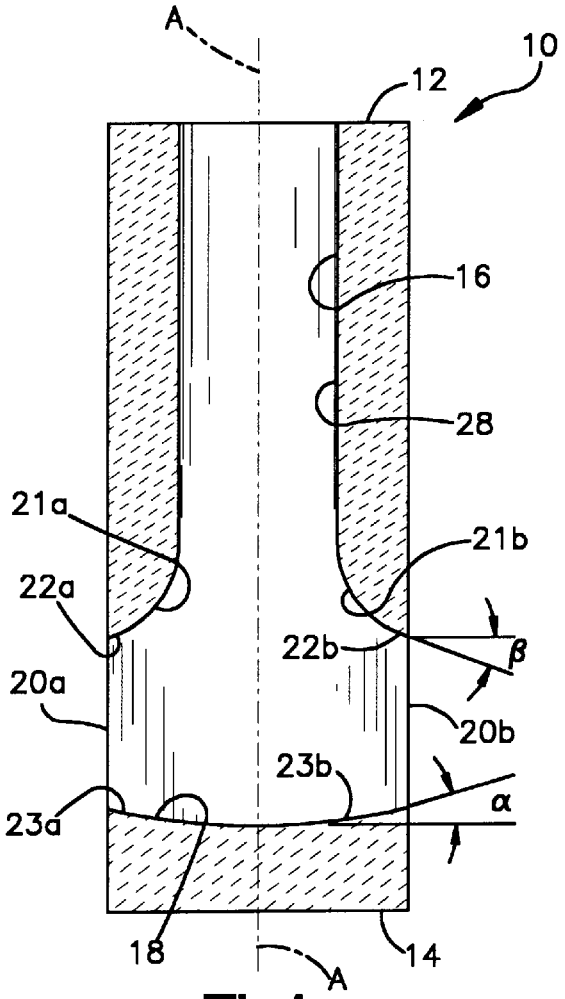
FIG. 1 is a vertical cross-sectional view of a submerged entry nozzle constructed in accordance with the present invention.
Figure 2:
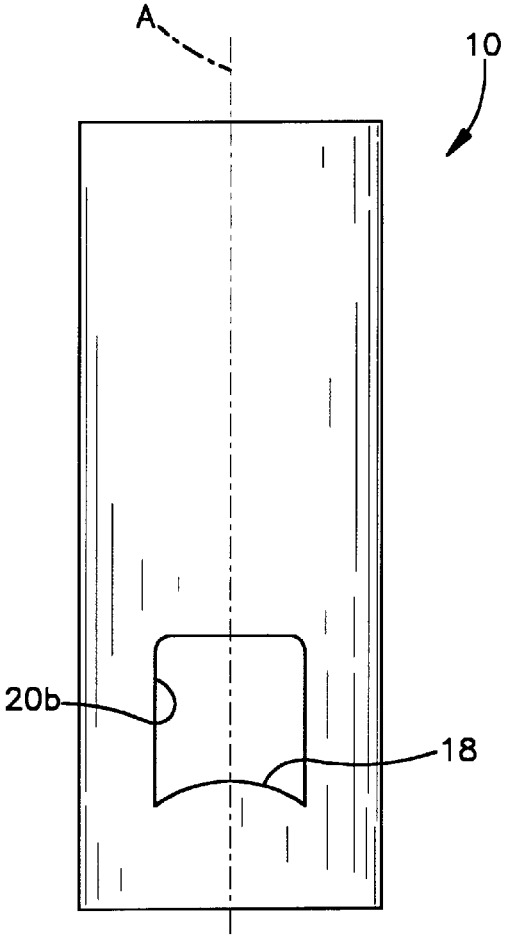
FIG. 2 is a side elevational view of the nozzle shown in FIG. 1.
Figure 3:
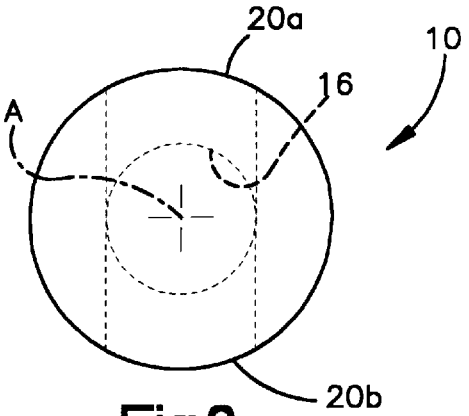
FIG. 3 is a bottom view of the nozzle shown in FIG. 1.

FIGS. 1–3 illustrate a submerged entry nozzle 10 for introducing molten steel into a casting mold. The nozzle 10 is constructed of generally tubular-shaped refractory material and includes a top end 12 adapted to connect to a tundish and a bottom end 14 that is submerged into the casting mold. A generally circular central bore 16 extends vertically and concentrically through the nozzle 10, the center of which is defined by the geometric center of the nozzle 10, indicated generally by the axis A—A.

As shown in FIGS. 1 and 3, the central bore 16 terminates at a dish-shaped bottom surface 18 that extends to the periphery of the nozzle 10 and is in fluid communication with a pair of exit ports 20*a,* 20*b* that extend transverse to the central bore 16. In the preferred embodiment, the exit ports 20*a,* 20*b* are about 180 degrees apart (as shown in FIG. 3). The exit ports 20*a,* 20*b* comprise upper regions 21*a,* 21*b* and lower regions 23*a,* 23*b*. The upper regions 21*a,* 21*b* are partially defined by respective downwardly slanted lips 22*a,* 22*b*. The lips 22*a,* 22*b* sweep from an interior wall 28 of the central bore 16 to the periphery or outer wall of the nozzle 10. The lower regions 23*a,* 23*b* of the exit ports 20*a,* 20*b* are partially defined by the dishshaped bottom surface 18. The dish-shaped bottom surface 18 is curved outwardly and upwardly from axis A—A to the periphery of the nozzle 10. Accordingly, the bottom surface 18 is positively sloped at an angle alpha with respect to a horizontal plane perpendicular to axis A—A. The lips 22*a,* 22*b,* on the other hand, are negatively sloped at an angle beta with respect to the horizontal plane.

According to the invention, the angles alpha and beta can vary between five and 35 degrees. The desired angle may depend on such factors as the size of the nozzle, the casting speed, the immersion depth of the nozzle and other features particular to a given caster design. In a preferred embodiment, angles alpha and beta are 15 degrees from the horizontal.

Figure 4:
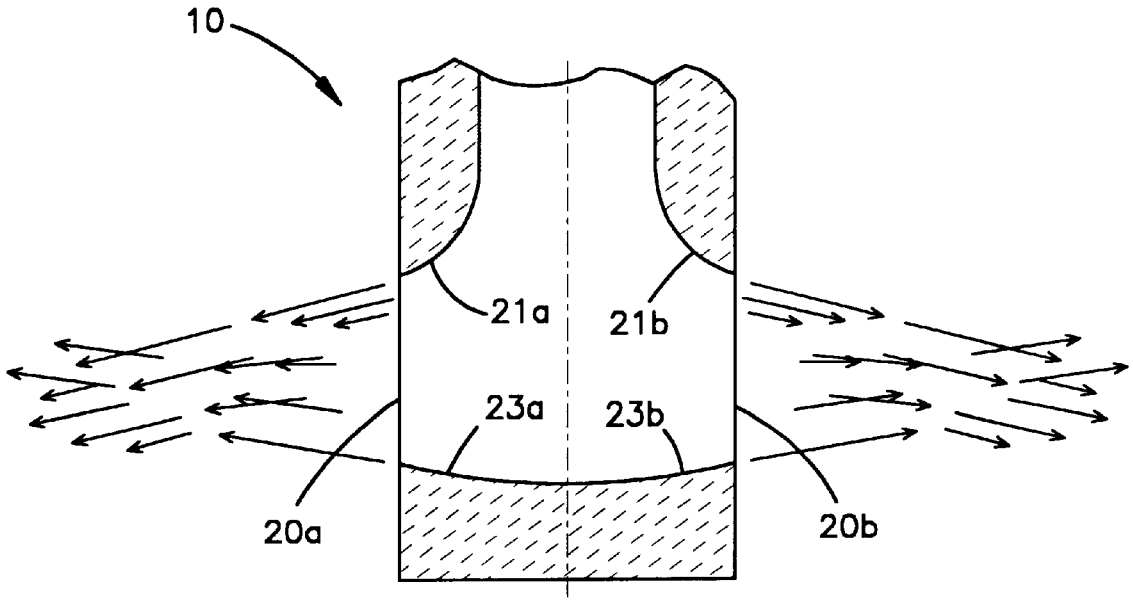
FIG. 4 is a fragmentary, cross-sectional view of the bottom end of the nozzle of FIG. 1 showing the flow path of molten steel as it issues from the nozzle.

FIG. 4 shows the flow path of liquid steel as it issues from the exit ports 20*a,* 20*b* of the entry nozzle 10. According to the invention, as liquid steel flows through the central bore 16 and the exit ports 20*a,* 20*b,* the upper regions 21*a,* 21*b* direct the flow of steel downward from the horizontal, while the lower regions 23*a,* 23*b* direct the steel in an upward direction that collides with, or impinges upon, a portion of the flow directed from the upper regions 21*a,* 21*b*.

Figure 5A:
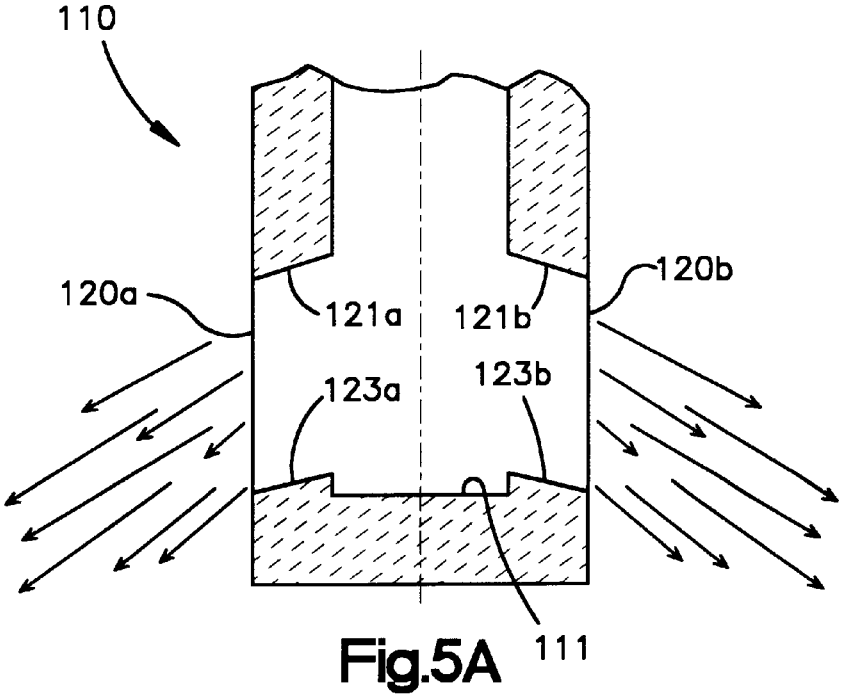
Fig.5A PRIOR ART
FIG. 5A is a fragmentary, cross-sectional view of the bottom end of a conventional nozzle showing the flow path of molten steel as it issues from the nozzle.
Figure 5B:
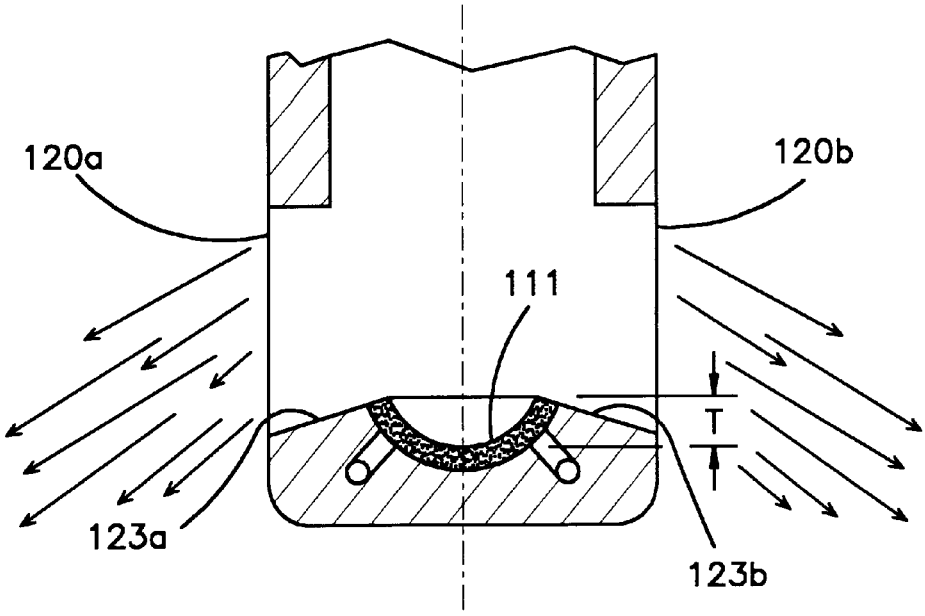
Fig.5B PRIOR ART
FIG. 5B is a fragmentary, cross-sectional view of the bottom end of a conventional nozzle showing the flow path of molten steel as it issues from the nozzle.
Figure 5C:
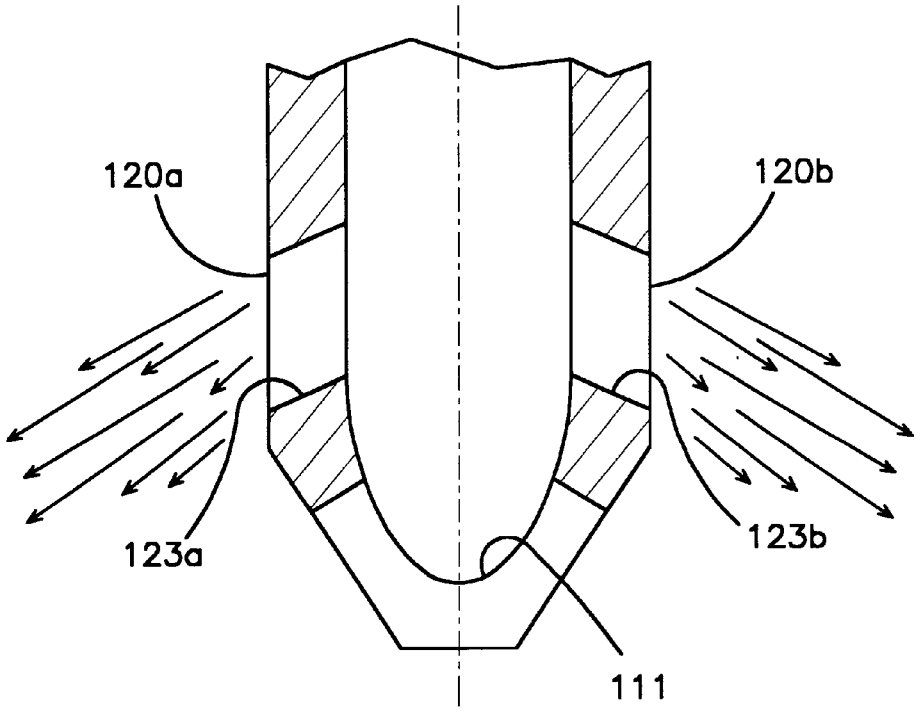
Fig.5C PRIOR ART
FIG. 5C is a fragmentary, cross-sectional view of the bottom end of a conventional nozzle showing the flow path of molten steel as it issues from the nozzle.

These flow characteristics provide several advantages over conventional submerged nozzles. By way of comparison, the conventional nozzles illustrated in FIGS. 5A, 5B and 5C are characterized by a well 111, some of which are partially dished (FIGS. 5B and 5C), in the bottom end of the nozzle. In none of these known prior art nozzles does the well 111 extend to the periphery of the nozzle as it does in the disclosed invention. In addition, the prior art nozzles 110 illustrated in FIGS. 5A, 5B, and 5C are characterized by exit ports 120*a,* 120*b* having outwardly and downwardly sloped surfaces 123*a,* 123*b*. This results in the exit ports 120*a,* 120*b* directing the liquid stream in a generally downward direction from the horizontal in the vicinity of the exit ports 120*a,* 120*b,* as is represented by the arrows in FIGS. 5A, 5B, and 5C. This effects a concentrated and turbulent flow path in the liquid steel as it exits the nozzle 110.

Unlike conventional nozzles 110, the dish-shaped bottom surface 18 of the present invention extends outwardly and upwardly at the periphery of the nozzle 10, thereby directing the flow of liquid steel upwardly from the horizontal in the vicinity of the exit ports 20*a,* 20*b,* as is represented by the arrows in FIG. 4. Consequently, a greater portion of the liquid steel is directed towards the meniscus than what conventional nozzles have achieved. A comparison of the flow paths shown in FIG. 4 and FIGS. 5A, 5B and 5C shows that the flow path of the liquid steel issuing from the nozzle 10 of the present invention is substantially more horizontal compared to that for the conventional nozzle 110. This effects a quiescent flow path which reduces turbulence at the meniscus and, therefore, reduces the likelihood of entraining molten slag into the liquid steel stream.

The submerged entry nozzle 10 establishes a flow pattern in the casting mold that promotes heat delivery to the meniscus at a substantially improved rate over that which conventional nozzles have been able to attain without argon injection. This ensures that the temperature of the steel near the meniscus will be sufficiently high for melting the mold powder and thereby providing a sufficiently uniformly thick mold slag layer for absorbing impurities and serving as a lubricant between the caster and the mold as the molten steel solidifies.

Some prior art nozzles have relied on argon gas injection in the nozzle to achieve higher temperatures near the meniscus of the molten cast, whereby the argon gas buoyantly directs the molten steel towards the meniscus. The flow characteristics of the present invention eliminate or substantially reduce the need for argon gas injection. By eliminating the use of argon injection, the present invention reduces the likelihood of pencil pipe defects caused by bubbles of argon gas remaining under the solidifying shell of the molten cast. Furthermore, since the flow path of the present invention generates higher temperatures near the meniscus than what conventional nozzles have achieved, it is less likely that freezing of the molten steel near the meniscus will occur. Consequently, there is a reduced likelihood of the surface defects known as "slivers."

Experiments were conducted to demonstrate the advantages of the flow characteristics of the submerged entry nozzle 10 of the present invention over those of the conventional nozzles 110 shown in FIG. 5A. Specifically, water model simulations were performed on a 0.4 scale water model caster. Velocity profiles in the water models were measured using a Particle Image Velocimetry (PIV) technique.

Figure 6:
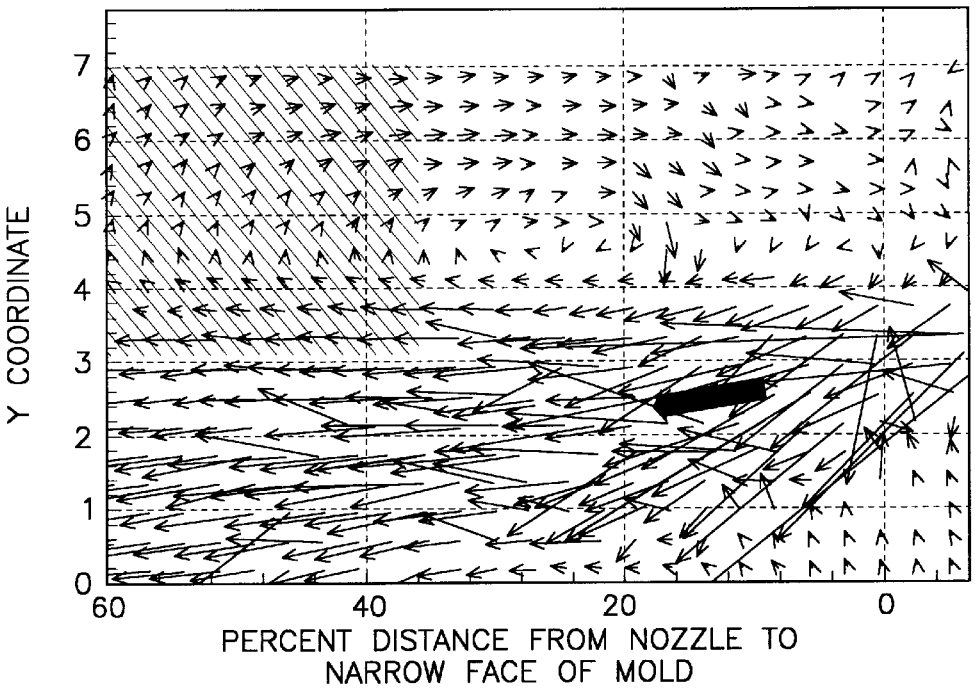
FIG. 6 is a graph showing a velocity profile in the upper portion of a mold of the nozzle shown in FIG. 1.
Figure 7:
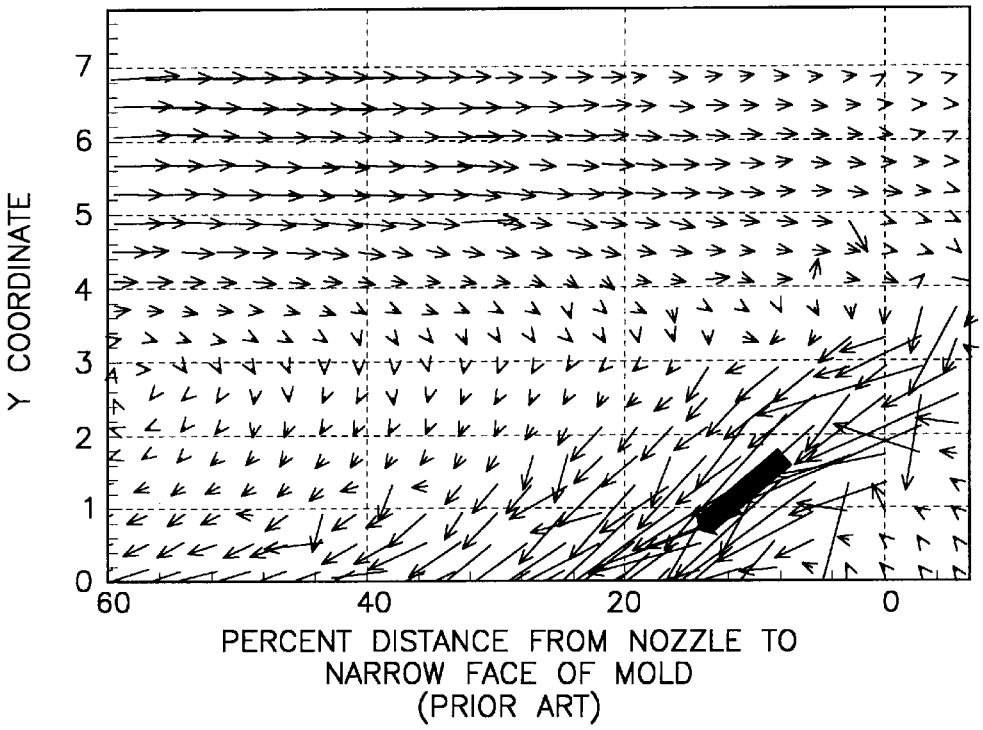
FIG. 7 is a graph showing a velocity profile in the upper portion of a mold of a conventional nozzle.

FIGS. 6 and 7 represent vertical planes in the liquid steel mold (the planes being parallel to the plane of the page) showing the velocity vectors of the liquid steel exiting the respective nozzles 10, 110 in the upper portion of the mold. The right portion of each figure represents a vertical plane (perpendicular to the plane of the page) through which axis A—A of the nozzle lies. The left most portion of each figure represents a vertical plane (perpendicular to the plane of the page) that is about 60% of the distance from axis A—A of the nozzle to the edge (not shown) of the mold; the edge being the narrow face in a 73-inch wide mold. Gas injection was absent in both nozzle experiments. The casting speed was about 50 inches per minute and the immersion depth of each nozzle was about six inches.

It was found that the exit ports 120*a,* 120*b* of the conventional nozzle 110 directed the water downwardly at an angle (generally indicated by arrow 140 in FIG. 7) steeper than what was experienced by the nozzle 10 of the present invention (generally indicated by arrow 40 in FIG. 6). Consequently, the liquid steel stream from the nozzle 10 of the present invention experiences a shallower penetration depth than that of the conventional nozzle 110.

Figure 8:
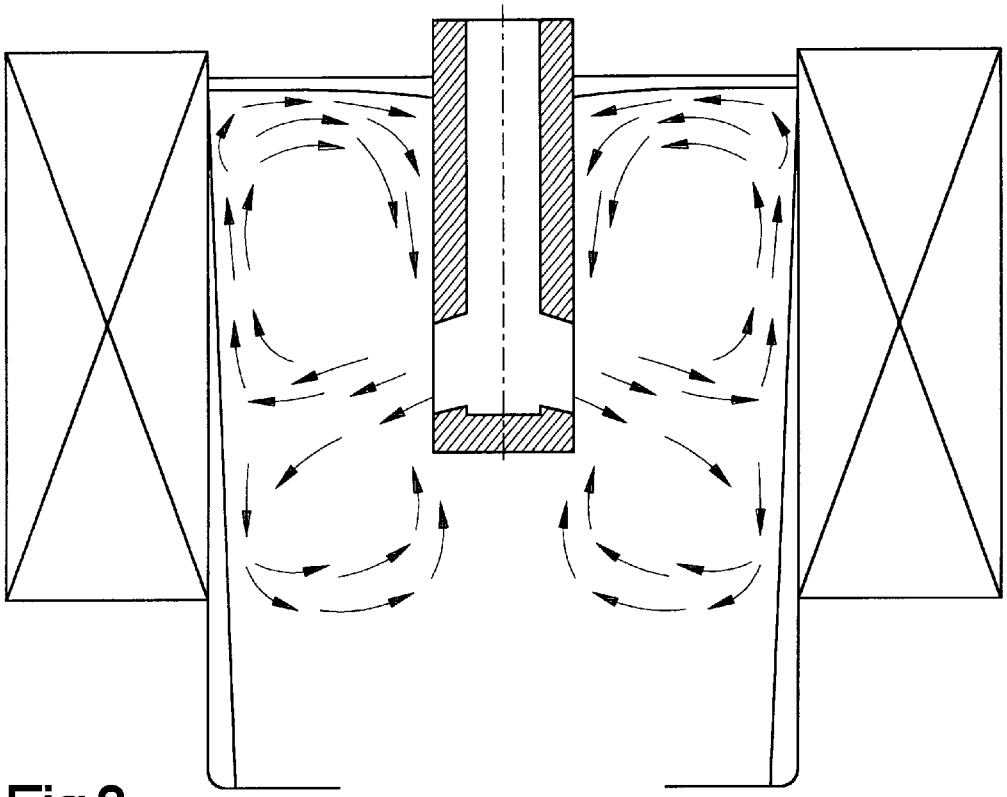
Fig.8 PRIOR ART
FIG. 8 illustrates a double roll flow pattern of molten steel in a mold with a conventional nozzle.

As shown in FIG. 8, the liquid steel issuing from the conventional nozzle 110 impinges on the narrow face and separates into two paths, known in the art as the double roll pattern. One portion flows upwardly along the narrow face and then returns along the meniscus and towards the nozzle 110. The other portion flows downwardly and also returns towards the nozzle 110. The double roll flow pattern results in a standing wave profile, causing a nonuniform thickness of the mold slag layer whereby the mold slag is relatively thinner near the narrow face than at or around the nozzle 110.

Figure 9:
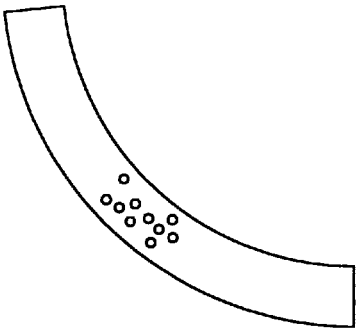
FIG. 9 illustrates entrapment of argon inclusion agglomerates under the solidifying shell and curvature of the curved mold inner radius.

The deep penetration of the liquid steel stream from the conventional nozzle 110 also increases penetration of argon gas inclusion agglomerates or bubbles deep into the molten steel pool. As is generally shown in FIG. 9, attempts of the argon gas to float upward are inhibited by the entrapment of the argon inclusion agglomerates under the solidifying shell of the inner radius of the curved mold. Subsequent processing of the steel, e.g. annealing, results in the pencil pipe defect by the entrapped gas bubbles expanding and forming blisters on the surface of the rolled product.

Referring now to FIG. 6, it is seen that the flow profile of the liquid steel issuing from the nozzle 10 of the present invention is substantially more horizontal compared to that for the conventional nozzle 110 shown in FIG. 7. Consequently, the liquid steel penetration depth is lower and argon inclusion agglomerates penetrate to a lesser distance below the curvature of the curved mold inner radius. Therefore, the likelihood of the argon inclusion agglomerates getting entrapped under the inner radius and later forming pencil pipe defects is substantially reduced.

It is also seen that the steel velocity near the meniscus is substantially lower for the nozzle 10 of the present invention than it is for the conventional nozzle 110. This reduces the likelihood of entraining particles from the mold slag layer into the recirculating liquid stream in the mold and later causing defects such as slivers or pencil pipe. This was confirmed by water modeling tests in which silicon oil was used to simulate the mold slag. The tests showed that under conditions of no gas injection, the nozzle 10 of the present invention produced a calm and flat meniscus (in contrast to the standing wave profile of the conventional nozzle 110) even at casting speeds as high as 60 inches/min. The conventional nozzle 110, on the other hand, started entraining slag at casting speeds below 45 inches/min. It is therefore believed that by use of the submerged entry nozzle 10 of the present invention casting can be performed at higher speeds than those attained by use of the conventional nozzle 110. Consequently, the overall productivity of the caster is substantially improved.

FIG. 6 shows that, unlike the conventional nozzle 110 wherein the molten steel stream does not flow towards the meniscus until the stream first impinges on the narrow face, the nozzle 10 of the present invention directs portions of the molten steel stream towards the meniscus shortly after the steel exits the nozzle 10. The upper left corner of FIG. 6 shows that the meniscus-directed flow begins when the steel from the submerged entry nozzle 10 has reached only about 40% of the distance from the nozzle 10 to the narrow face. Thus, the liquid steel discharged from the exit ports 20*a,* 20*b* of the nozzle 10 of the present invention is directed towards the meniscus sooner than the steel discharged from the exit ports 120*a,* 120*b* of the conventional nozzle 110. Therefore, even though the nozzle 10 of the present invention reduces the velocity of the molten steel in the meniscus region, the heat from the incoming liquid steel stream is delivered to the meniscus in sufficient enough time that the temperature of the meniscus is sufficiently high to melt the mold powder and provide proper lubrication for casting.

Water model tests were conducted on the nozzles 10, 110 to demonstrate that the nozzle 10 of the present invention could deliver adequate heat to the meniscus at the same or an improved rate as the conventional nozzle 110. Hot water was delivered through the respective nozzles 10, 110 into a relatively cooler (room temperature) pool of water representing the liquid steel in the mold. The temperature response was measured and averaged for each nozzle 10, 110 over a range of points at the meniscus.

Figure 10:
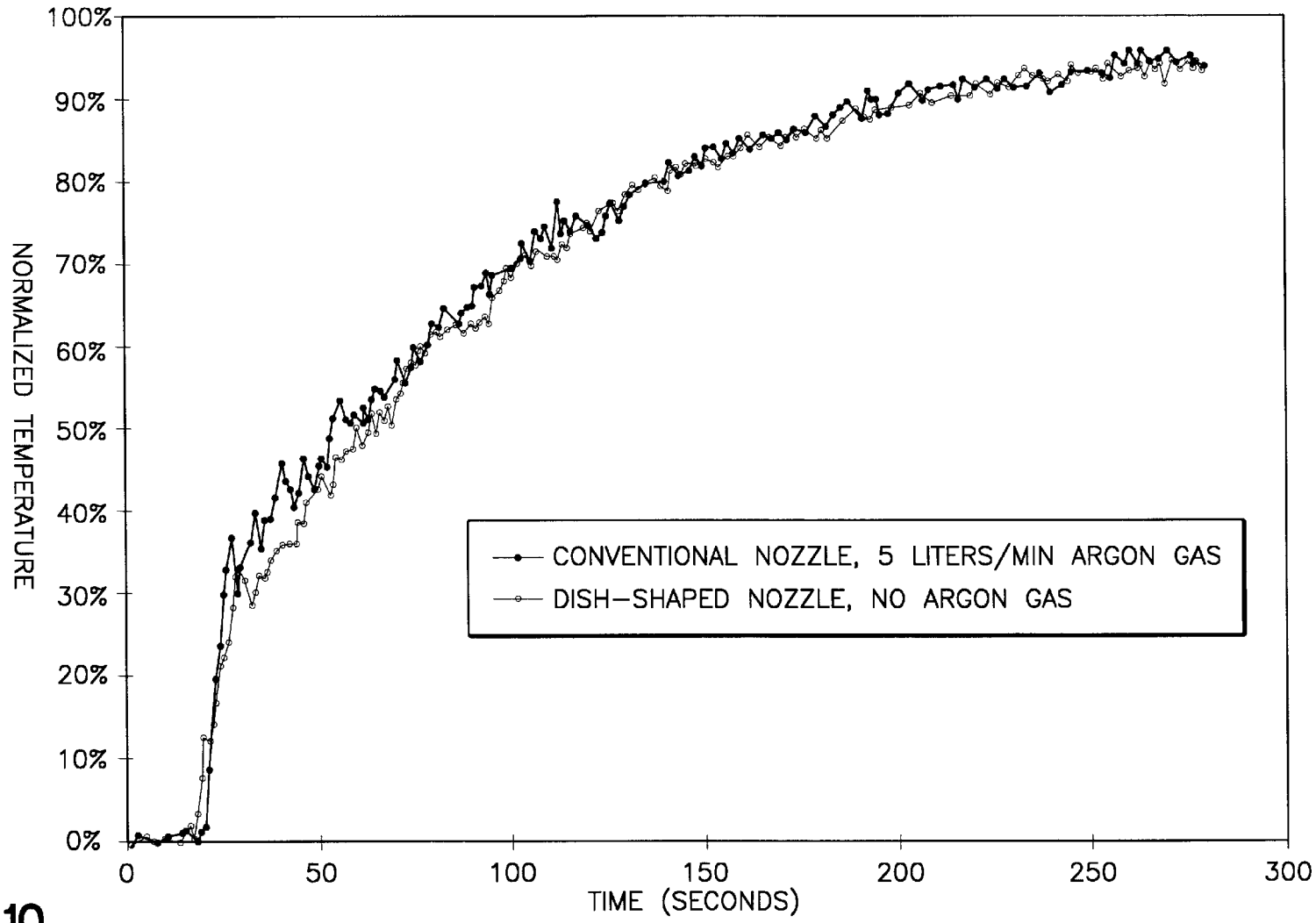
FIG. 10 is a graph showing the thermal response in the meniscus of a steel mold that compares a conventional nozzle with the submerged entry nozzle constructed in accordance with the present invention.

FIG. 10 shows an example of a comparison of the temperature at the meniscus between the nozzle 10 of the present invention with no argon gas injection and the conventional nozzle 110 with 5 liters per minute of gas injection. The ability of the flow paths of the respective nozzles 10, 110 to deliver sufficient heat to a particular point at the meniscus is indicated by the initial rise in the temperature in the 20 to 30 second range. As FIG. 10 shows, the thermal response of the nozzle 10 with no argon gas injection is similar to that of the conventional nozzle 110 with 5 liters per minute of argon gas injection.

Although the present invention has been described with a certain degree of particularity, it should be understood that those skilled in the art can make various changes to it without departing from the spirit or scope of the invention as hereinafter claimed.

I claim:

1. A submerged entry nozzle for introducing molten steel into a casting mold comprising:

a) nozzle structure defining a central bore and two transverse exit ports communicating with the bottom of said central bore;

b) said central bore terminating at an upwardly dish-shaped bottom surface that extends to the periphery of said nozzle structure and forms the lower surface regions of said exit ports, whereby molten steel flowing across said upwardly dish-shaped bottom surface is directed outwardly and upwardly from said exit ports; and c) said exit ports have upper regions partially defined by downwardly slanted lips whereby the flow of molten steel across said lips is directed outwardly and downwardly into the exit flow of molten steel along said upwardly dish-shaped bottom surface.

2. The submerged entry nozzle of claim 1, wherein said upwardly dish-shaped bottom surface is positively sloped at about an angle of 5 to 35 degrees with respect to a plane perpendicular to the vertically extending central bore.

3. The submerged entry nozzle of claim 1, wherein said downwardly slanted lips are negatively sloped at about an angle of 5 to 35 degrees with respect to a plane perpendicular to the vertically extending central bore.

* * * * *